US008025493B2

(12) United States Patent
Petrov

(10) Patent No.: US 8,025,493 B2
(45) Date of Patent: Sep. 27, 2011

(54) APPARATUS FOR MANUFACTURING A PRE-CAST RETAINING WALL

(76) Inventor: George Petrov, Lutz, FL (US)

( * ) Notice: Subject to any disclaimer, the term of this patent is extended or adjusted under 35 U.S.C. 154(b) by 225 days.

(21) Appl. No.: 12/539,830

(22) Filed: Aug. 12, 2009

(65) Prior Publication Data

US 2011/0038972 A1 Feb. 17, 2011

(51) Int. Cl.
*B28B 7/02* (2006.01)
*E04G 11/22* (2006.01)

(52) U.S. Cl. ..... 425/3; 425/DIG. 33; 249/101; 249/139; 249/158; 249/162; 249/168; 249/170

(58) Field of Classification Search ..... 249/18, 249/24, 29–36, 55, 63–64, 101, 102, 112, 249/120, 122–126, 129–132, 139, 151, 155, 249/156, 158, 160–163, 165, 168–170, 175–177, 249/184, 186, 189; 264/33; 425/3, 63–65, 425/468, DIG. 33
See application file for complete search history.

(56) References Cited

U.S. PATENT DOCUMENTS

| | | | | | |
|---|---|---|---|---|---|
| 1,685,012 | A * | 9/1928 | Yager | 249/177 |
| 2,458,155 | A * | 1/1949 | Fraser | 249/101 |
| 3,618,889 | A * | 11/1971 | Lipski | 249/50 |
| 3,827,666 | A * | 8/1974 | Dreher | 249/18 |
| 4,228,985 | A * | 10/1980 | Gaudelli et al. | 249/93 |
| 4,321,024 | A * | 3/1982 | Terraillon | 425/111 |
| 4,482,126 | A * | 11/1984 | Toffolon | 249/159 |
| 4,695,031 | A * | 9/1987 | Proctor | 249/91 |
| 5,202,132 | A * | 4/1993 | Myers et al. | 425/62 |
| 5,593,709 | A * | 1/1997 | Thomson et al. | 425/454 |
| 5,766,645 | A * | 6/1998 | Kaminski | 425/63 |
| 5,857,300 | A * | 1/1999 | Gates | 52/426 |
| 6,247,677 | B1 * | 6/2001 | Vinet et al. | 249/189 |
| 6,550,215 | B1 * | 4/2003 | Pulte et al. | 52/781.5 |
| 2002/0000506 | A1 * | 1/2002 | Khoo | 249/18 |

FOREIGN PATENT DOCUMENTS

| | | | |
|---|---|---|---|
| DE | 3443292 | A1 * | 5/1986 |
| EP | 439399 | A1 * | 7/1991 |
| WO | WO 9301924 | A1 * | 2/1993 |

* cited by examiner

*Primary Examiner* — Joseph S Del Sole
*Assistant Examiner* — Dimple Bodawala
(74) *Attorney, Agent, or Firm* — Pitts, Lake & Bell, P.C.

(57) ABSTRACT

An adjustable mold for manufacturing a pre-cast cantilevered concrete retaining wall. The adjustable mold includes a base, at least one upright form disposed substantially perpendicular and adjacent to the base, and a plurality of rails interchangeable and repositionable adapted to be secured to the base to vary the size and surface features of the retaining wall. The base, the upright form, and the plurality of rails cooperate to define a plurality cavities in fluid communication that shape and allow sufficient curing of a combination of fluid concrete and concrete reinforcement to form a retaining wall of a selected configuration. A top surface of the base is contoured to define the mold negative of a textured shape desirable for the external surface of the pre-cast cantilevered concrete retaining wall.

15 Claims, 13 Drawing Sheets

APPARATUS FOR MANUFACTURING A PRE-CAST RETAINING WALL

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to pre-cast retaining walls. More particularly, this invention pertains to an apparatus for manufacturing pre-cast cementitious retaining walls such as reinforced concrete retaining walls.

2. Description of the Related Art

Retaining walls are commonly used in a wide variety of construction, civil engineering, and landscaping applications, for example, to support earth, rock, sand, and other such materials forming slopes and embankments (hereinafter "embanked materials") and to limit down-slope movement, such as erosion, landslides, etc., of the embanked materials. Retaining walls are commonly formed by constructing a substantially rigid wall in front of an embankment and then placing and compacting soil or other fill (hereinafter "backfill") behind the wall to allow the wall to support the embanked materials in the configuration of the embankment.

One common method of constructing a retaining wall is to form the retaining wall from reinforced concrete which is poured in place at the location of the finished retaining wall. For example, in a traditional cantilevered retaining wall, a poured-in-place steel-reinforced concrete structural footing is constructed along the base of an embankment to extend horizontally along the embankment. Thereafter, concrete forms are erected above the structural footing, and a panel of steel-reinforced concrete is poured in place and integrally formed with the footing to extend upward across the surface of the embankment to form a wall. After the concrete has properly cured, the concrete forms are removed, and backfill is placed between the finished retaining wall and the embankment. The traditional cantilevered retaining wall then functions by cantilevering loads from along the wall panel to along the length of the structural footing so as to convert horizontal loads imparted to the wall panel from the embankment to vertical loads along the ground beneath the footing.

In constructing poured-in-place concrete retaining walls, problems arise in the difficulty of labor, time, and expense associated with erecting the concrete forms, pouring the concrete in place, and allowing the concrete to properly cure prior to removing the forms and backfilling the embankment. In several situations, erosion and/or landslides of the embanked materials occur prior to completion of the poured-in-place concrete retaining wall. Moreover, the concrete surfaces of traditional poured-in-place concrete retaining walls are often viewed as unsightly and not aesthetically pleasing.

Thus, in recent years, masonry units such as stone blocks, concrete masonry units, bricks, and the like have gained wide popularity for use in fabricating retaining walls having an aesthetically attractive appearance. It is well-known in the art to fabricate such masonry retaining walls either by arranging the masonry units in a stacked configuration to form a wall along the surface of the embankment or by joining the masonry units in the stacked configuration using a cement binder. Masonry units suitable for use in fabricating retaining walls are typically weighted such that the finished retaining wall exhibits a weight capable of resisting capsizing due to horizontal loads placed along the retaining wall by the embanked materials, thereby retaining the embanked materials substantially within their embanked configuration.

Though retaining walls fabricated from masonry units are often considered more attractive than reinforced concrete retaining walls, a wall fabricated from masonry units is typically not as structurally sound as a reinforced concrete wall of similar size and weight. Thus, masonry retaining walls must typically be constructed of thicker and often heavier materials than reinforced concrete retaining walls of similar structural strength. Furthermore, in situ construction of masonry retaining walls is also labor intensive, often requiring significant time and expense. Thus, it is not uncommon for erosion and/or landslides of the embanked materials to occur prior to completion of a masonry retaining wall.

In the reinforced concrete industry, pre-cast reinforced concrete structures, such as pre-cast reinforced concrete beams, columns, slabs, etc., are known in the art. Such pre-cast concrete structures allow a builder to pour concrete into a desired shape and allow the concrete to cure in a location removed from the finished concrete structure. Thereafter, when the pre-case concrete structure is needed for building construction, it is brought to the location of the construction and quickly placed in the desired finished location. In this manner, the time and labor associated with forming, pouring, and curing pre-cast concrete occurs prior to the on-site construction process, thereby increasing the speed with which such pre-cast concrete structures can be utilized.

Accordingly, there is a need to fabricate a pre-cast concrete retaining wall which is capable of exhibiting the strength-per-unit-thickness of a reinforced concrete retaining wall along with the aesthetically pleasing appearance of a masonry retaining wall, and which can be transported to the site of an embankment for speedy placement at a desired location to serve as a retaining wall.

BRIEF SUMMARY OF THE INVENTION

The present invention is an adjustable mold for manufacturing a pre-cast retaining wall. The adjustable mold includes a base, at least one footing form, and a plurality of rails. The base, footing form, and plurality of rails cooperate to define a cavity adapted to hold a combination of fluid concrete and concrete reinforcement in the shape of a pre-cast cantilevered concrete retaining wall and to allow curing of the fluid concrete sufficient to form the pre-cast cantilevered concrete retaining wall.

The base includes a generally level, rectangular platform which is carried and supported by a frame. A top surface of the platform defines the mold negative of a textured shape desirable for the external surface of a pre-cast wall. A plurality of side rails are selectively securable to the platform along opposite edges of the platform top surface. Each side rail defines an interior surface adapted to be configured substantially orthogonally to the platform top surface to form portions of the adjustable mold corresponding to side surfaces of the vertical wall portion of a pre-cast wall. In one embodiment, a first side rail interior surface defines a mold negative of a groove disposed linearly along the first side rail interior surface, while a second side rail interior surface defines a mold negative of a tongue keyed to the groove of the first side rail interior surface. In this embodiment, a pre-cast wall manufactured from the adjustable mold exhibits side surfaces defining tongue and groove connectors suitable for forming a tongue and groove joint connection with an adjacent pre-cast wall. In another embodiment, each side rail is adapted to be selectively reversible proximate the platform to allow either a first surface or an opposite second surface of the side rail to face toward the interior of the cavity.

At least one header rail is provided to be selectively secured proximate the platform spanning between the side rails, thereby forming the portion of the adjustable mold corresponding to the top surface of the vertical wall portion of the pre-cast wall. The header rail defines at least one upright surface adapted to be configured substantially orthogonally to the platform top surface and substantially orthogonally to each of the side rail interior surfaces. In one embodiment, a plurality of elongated rail raisers are provided to extend the vertical thicknesses of the interior surfaces of the first and second side rails and the vertical thickness of the header rail. Locks are provided to selectively secure the various rails and rail raisers along the platform.

At least one footing form is supported by the frame and is provided along an edge of the platform to form the portion of the adjustable mold corresponding to the structural footing portion of the pre-cast concrete retaining wall. The footing form includes an upright wall secured to the frame in an orientation substantially parallel to and spaced apart from the platform. The wall has an upper portion having a vertical elevation higher than the vertical elevation of the platform top surface and a lower portion having a vertical elevation lower than the vertical elevation of the platform top surface. In one embodiment, the overall height of the wall is selectively adjustable.

A channel is defined between the wall and the platform extending along the platform below the platform top surface. In one embodiment, two selectively removable channel bulkheads, each having a planar inner surface keyed to the cross-sectional shape of the channel, are provided. Each channel bulkhead is operatively secured within a corresponding end of the channel such that the channel bulkhead inner surfaces serve to limit the flow of fluid concrete outwardly from within the channel. A selectively removable channel blockout is provided to optionally limit fluid concrete from entering the channel.

The upright form further includes a first bulkhead side member and a second bulkhead side member. Each of the first and second bulkhead side members is rotatably secured along first side edges to opposite side edges of a substantially rectangular central bulkhead member. Second side edges of each of the first and second bulkhead side members are rotatably secured to opposite side edges of the wall. Suitable rotatable and releasable connections are provided along corresponding connective edges of the wall, the first and second bulkhead side members, and the central bulkhead member such that the central bulkhead member is selectively openable and closable proximate the wall and the platform. In one embodiment, the central bulkhead member is rotatably connected to the first and second bulkhead side members by hinges. A plurality of releasable rotatable connectors are provided to secure each of the first and second bulkhead side members to the wall. Each releasable rotatable connector includes a post having a first end which is hinged proximate a corresponding vertical edge of the wall. A second end of each post is adapted to be releasably secured proximate a corresponding bulkhead side member so as to form a rotatable connection between the corresponding bulkhead side member and the wall.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 13:
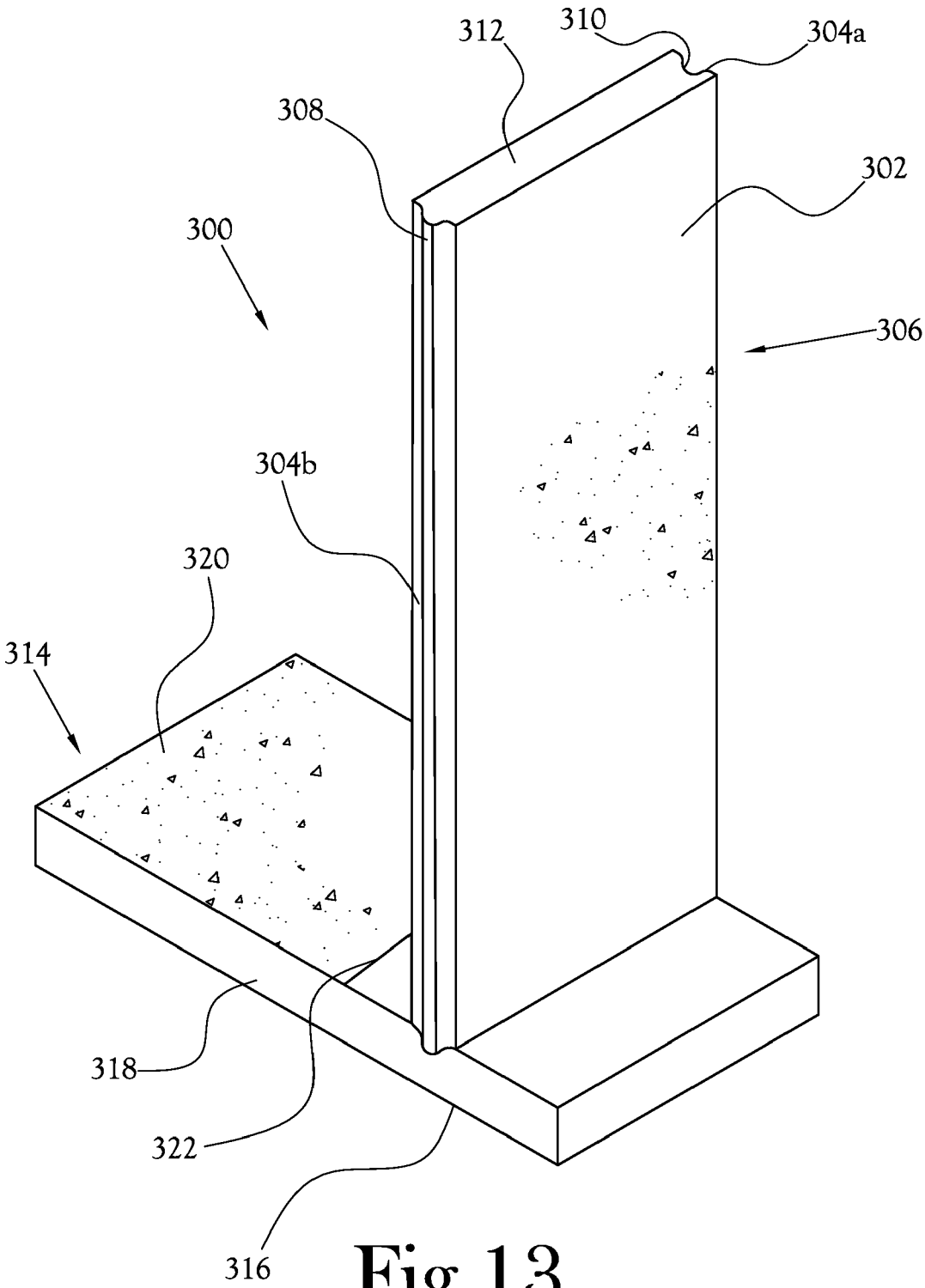
FIG. 13 is a perspective view showing a pre-cast retaining wall manufactured using one embodiment of the adjustable mold of the present invention.

Various embodiments of an adjustable mold for manufacturing a pre-cast cantilevered concrete retaining wall (hereinafter "pre-cast wall") of the type shown in FIG. 13 are described in detail and illustrated by the accompanying description and figures. The adjustable mold includes a base, at least one upright form disposed substantially perpendicular and adjacent to the base, and a plurality of rails interchangeable and repositionable adapted to be secured to the base to vary the size and surface features of the retaining wall. The base, the upright form, and the plurality of rails cooperate to define a plurality cavities in which a combination of fluid concrete and concrete reinforcement is shaped and at least partially cured to form a pre-cast wall of a selected configuration. A top surface of the base is contoured to define the mold negative of a textured shape desirable for the external surface of the pre-cast cantilevered concrete retaining wall.

Figure 1:
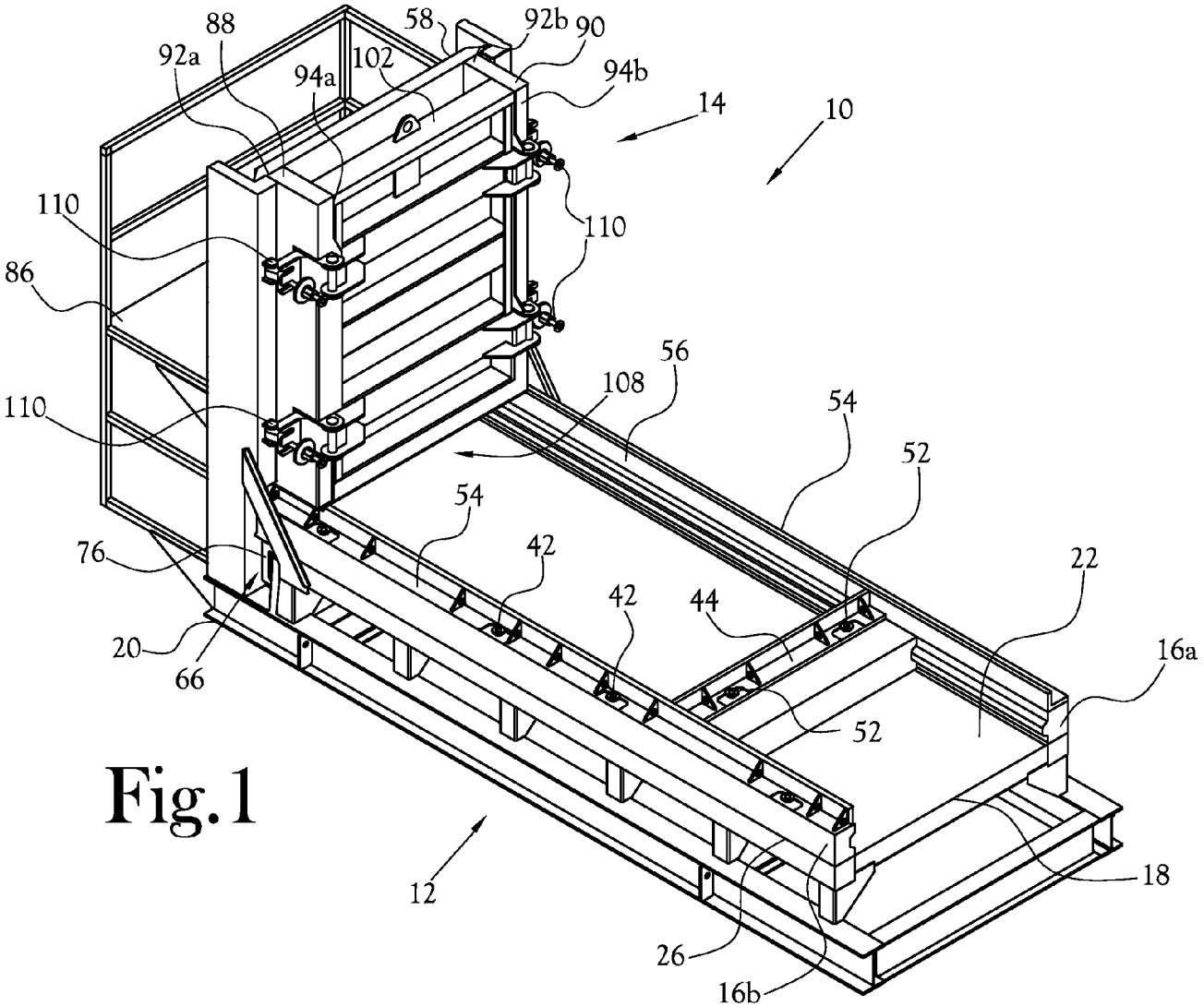
FIG. 1 is a perspective view of one embodiment of an adjustable mold for manufacturing a pre-cast retaining wall.

FIG. 1 is a perspective view of one embodiment of the adjustable mold 10 including a base 12, a footing form 14, and a plurality of rails 16*a*, 16*b*, 52. The base 12 includes a substantially level, rectangular platform 18 which is carried and supported by a frame 20. The platform 18 defines a first side 24 and an opposite second side 26, with a first end 28 and an opposite second end 30 adjacent therebetween. The side rails 16*a*, 16*b* are selectively securable to the platform 18 along the first and second platform side 24, 26 to form the side boundaries forming the portion of the adjustable mold defining the wall form. More specifically, the side rail interior surfaces 34*a*, 34*b* define a shape corresponding to the mold negative of a shape desirable for the side surfaces 304*a*, 304*b* of the vertical portion 306 of the pre-cast wall 300. The top surface 22 of the platform 18 forms a portion of the first cavity corresponding to the exterior vertical surface 302 of the vertical portion of the pre-cast wall 300. In the illustrated embodiment, the top surface 22 is a generally nondescript planar surface producing a pre-cast wall 300 with a flat, smooth-textured external surface 302. Additionally, the frame 20 supports an upright form 14 at the first end 28 of the platform 18 in an orientation substantially orthogonal to the top surface 22. The upright form 14 is the portion of the adjustable mold 10 corresponding to the structural footing portion of the pre-cast concrete retaining wall.

Figure 2:
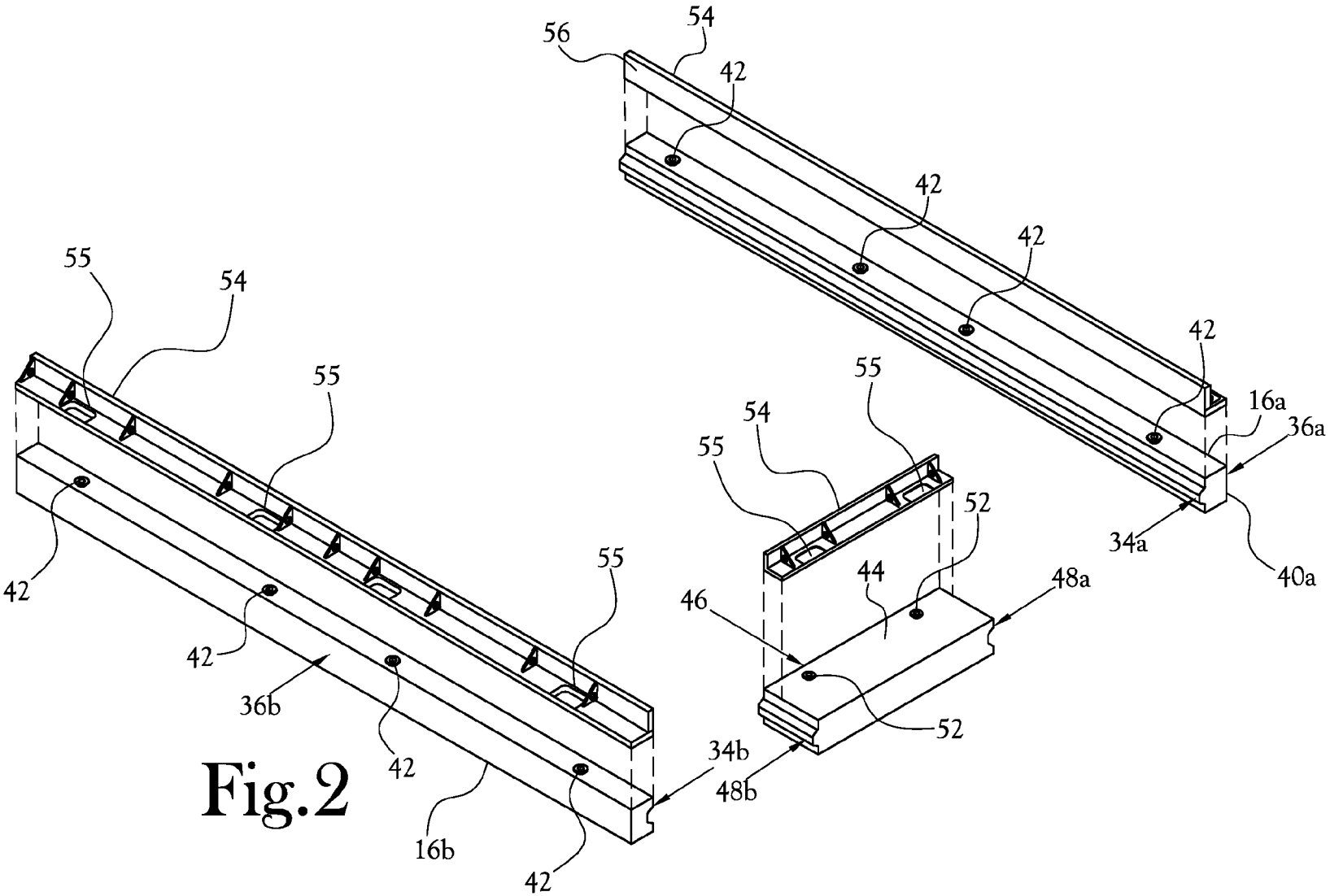
FIG. 2 is a partial exploded view showing the various rails and the trough bulkheads of the adjustable mold of FIG. 1.

FIG. 2 illustrates the rails of the adjustable mold 10 in greater detail. Each side rail 16*a*, 16*b* is selectively reversible relative to the platform 18 to allow either a first surface 34*a*, 34*b* or an opposite second surface 36*a*, 36*b* to face the interior of the first cavity. In the illustrated embodiment, the first surface 34*a* of the first side rail 16*a* defines the mold negative of a groove, while an opposite second surface 36*a* defines a planar surface. Conversely, a first surface 34*b* of the second side rail 16*b* defines the mold negative of a tongue, while an opposite second surface 36*b* defines a planar surface. Thus, each side rail 16*a*, 16*b* is selectively repositionable along the platform first and second sides 24, 26 to allow a user to selectively reconfigure the adjustable mold 10 from a configuration producing tongue and groove joint connections along the side surfaces of a product pre-cast wall, as illustrated in FIG. 13, to a configuration producing a pre-cast wall having substantially planar side surfaces. Thus, multiple pre-cast walls manufactured from the adjustable mold 10 can be selectively interlocked in a side-by-side configuration to form a continuous retaining wall structure. One skilled in the art will recognize other shapes and configurations for the first surfaces 34*a*, 34*b* of the side rails 16*a*, 16*b* that allow selective connectability of the pre-cast walls produced.

In the illustrated embodiment of FIG. 2, a header rail 44 spans between the side rails 16 to form an end boundary of the first cavity, which defines the top surface of the pre-cast wall 300. The header rail 44 is configured to be selectively repositioned and secured at a desired location along the length of the platform 18 to adjust the overall height of the finished pre-cast wall. The first and second side surfaces 48*a*, 48*b* of the header rail 44 each define a shape which is contoured to the cross-sectional shape of each of the corresponding side rail interior surfaces 34*a*, 34*b*, such that the header rail 44 forms an interface with each of the side rails 16 which is substantially impervious to fluid concrete when the header rail 44 is selectively secured across the platform 18 spanning between the side rails 16. Additionally, the header rail 44 defines an inner surface 46 that is substantially orthogonally to the platform top surface 22 and substantially orthogonally to each of the side rail interior surfaces 34*a*, 34*b*. The header rail inner surface 46*a* defines the mold negative of a shape desirable for the top surface 312 of the vertical portion 306 of the pre-cast wall 300. In one embodiment, the header rail inner surface 46*a* defines a substantially rectangular planar surface.

The side rails 16*a*, 16*b* are selectively secured to the platform top surface 22 by a plurality of fasteners or side rail locks 42. Similarly, a plurality of header locks 52 selectively secure the header rail 44 proximate the platform top surface 22 and the side rails 16. In one embodiment where the platform 18 is fabricated from a magnetic material, such as steel, the locks 42, 52 are defined by a magnetic fastening mechanism. One suitable magnetic fastening mechanism is the Klacker® Power Box manufactured by Ratec, LLC. In another embodiment, the locks are temporary mechnanical fastening mechanisms, such as pins (locking and non-locking), clips, and clamps. Those skilled in the art will recognize other suitable fasteners that may be used without departing from the spirit and scope of the present invention.

It will be understood that the maximum thickness of a vertical wall portion 306 of a pre-cast wall 300 which the adjustable mold 10 is capable of producing is generally defined by the vertical thicknesses of the interior surfaces 34*a*, 34*b* of the side rails 16*a*, 16*b* and the vertical thickness of the header rail upright surface 46. In the illustrated embodiment, elongated rail raisers 54 having a substantially vertical interior surface 56, are provided to extend the vertical thicknesses of the rails 16*a*, 16*b*, 44. Each of the rail raisers 54 is selectively secured along the top surface of a cooperating rail 16*a*, 16*b*, 44 such that the raiser interior surface 56 is parallel to and aligned (both horizontally and vertically) with the cooperating rail interior surface 34*a*, 34*b*, 46. In one embodiment, a plurality of openings 55 are provided along each rail raiser 54 to allow a cooperating lock 42, 52 to engage and secure the rail raiser 54 to the cooperating rail 16, 44. Those skilled in the art will recognize other suitable mechanisms for securing each rail raiser 54 to the cooperating rail 16*a*, 16*b*, 44 without departing from the spirit and scope of the present invention. In another embodiment, additional rails 16*a*, 16*b*, 44 are arranged in a vertically stacked configuration to vary the maximum thickness of the vertical wall portion 306 of the pre-cast wall 300 produced by the adjustable mold 10. In another embodiment, each of the rail raisers 54 is integrally formed with the cooperating rail 16*a*, 16*b*, 44.

Figure 3:
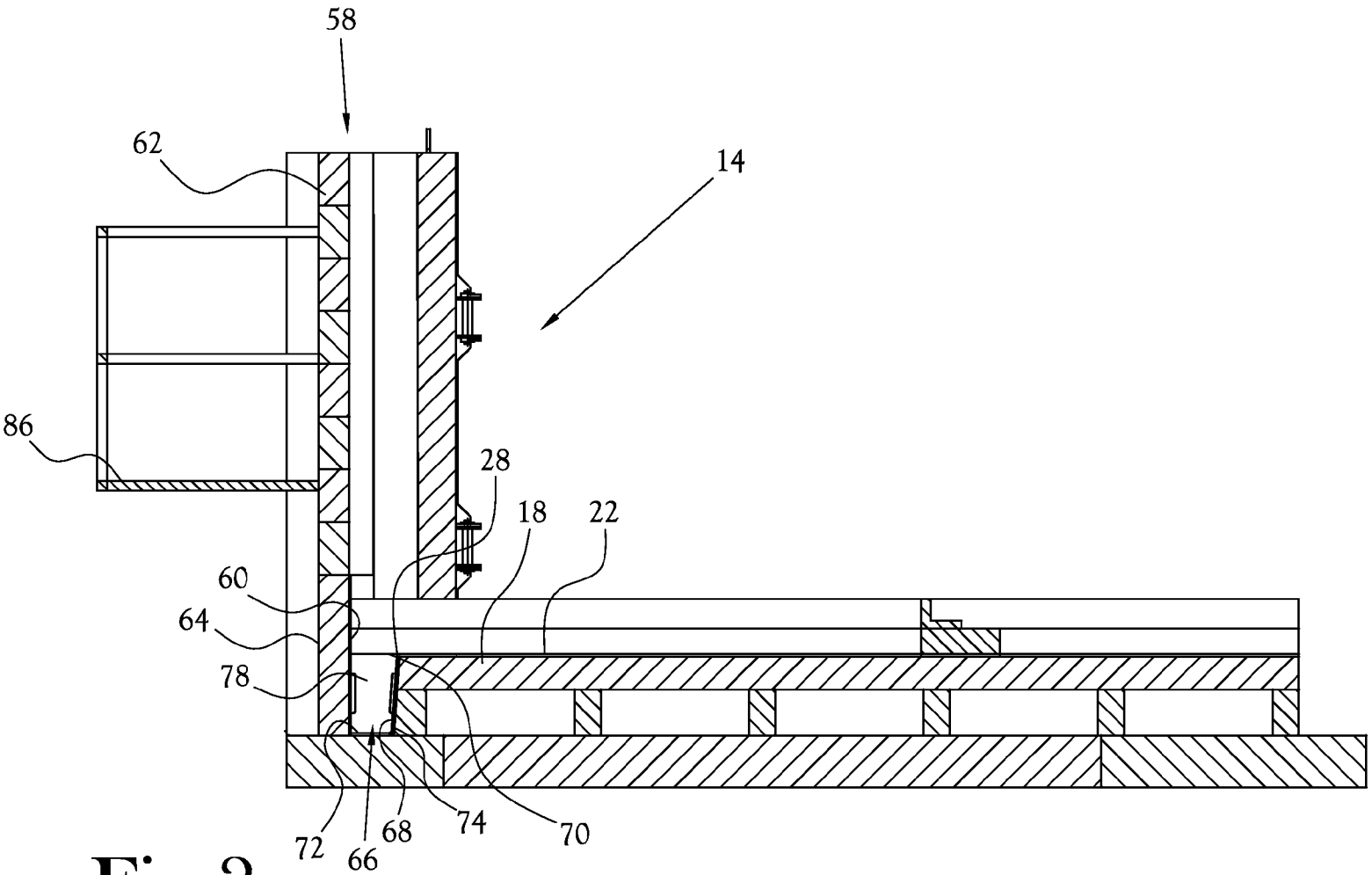
FIG. 3 is a side elevation section taken along the longitudinal centerline of the adjustable mold shown in FIG. 1.

FIG. 3 illustrates a sectional side view taken along the longitudinal centerline of the adjustable mold 10. The adjustable mold defines an upwardly opening channel 66 between the upright form wall 58 and the first end 28 of the platform 18. The channel 66 extends between and open to the sides of the adjustable mold 10 below the platform top surface 22. In the illustrated embodiment, the channel 66 is defined by a generally rectangular upright surface 68 having an upper edge 70 fixed along the platform first end 28 such that the upright surface 68 extends below the platform top surface 22. A rectangular bottom surface 72 is fixed between a lower edge 74 of the upright surface 68 and the wall lower portion 64 to extend generally orthogonally to the upright surface 68 and the wall inner surface 60. The channel 66 is selectively used to add a spur 316 to the pre-cast wall 300.

Figure 4:
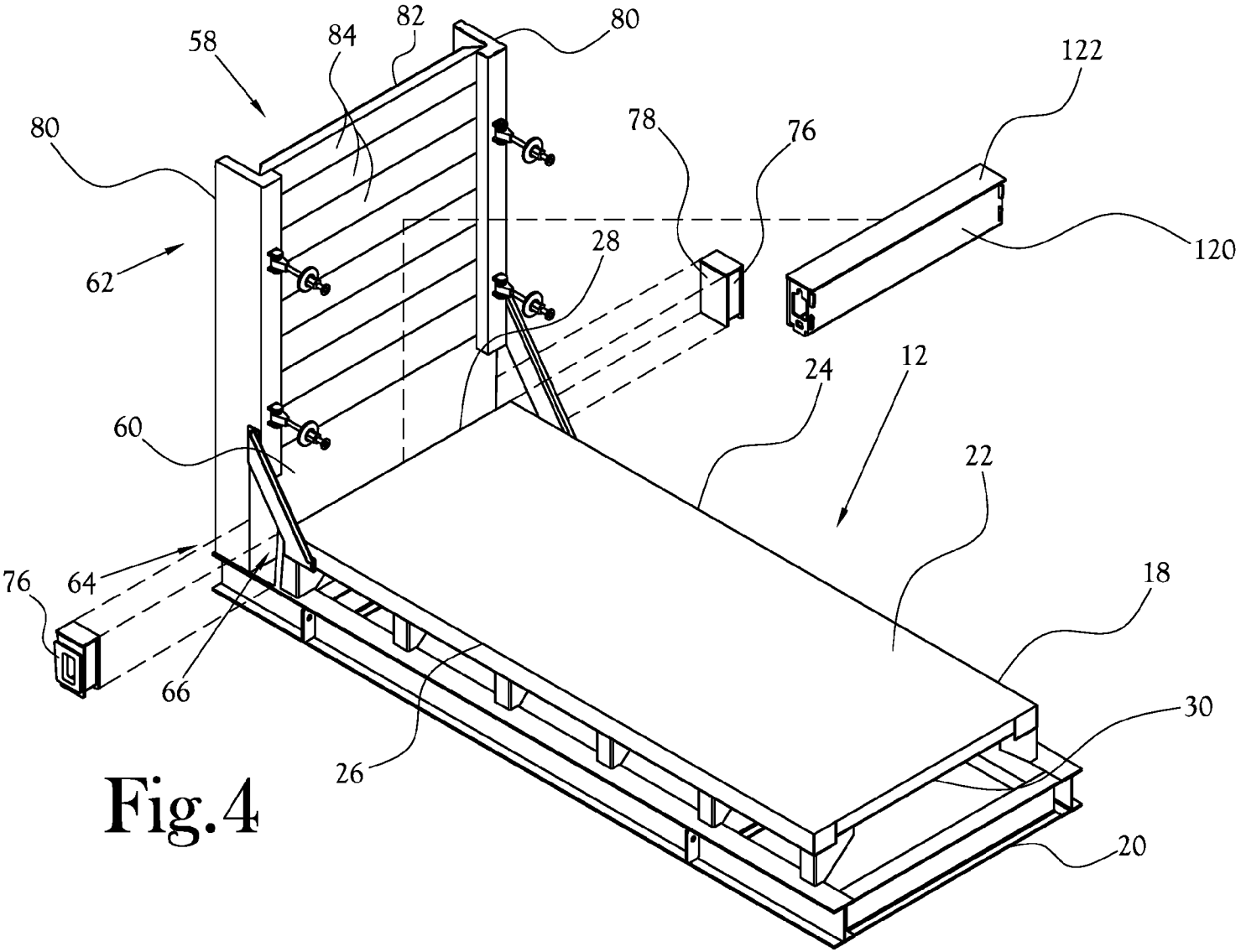
FIG. 4 is a perspective view of the base and wall portions of another embodiment of the adjustable mold.

FIG. 4 illustrates the adjustable mold with some components removed to better illustrate the components allowing for selective use of the channel. When adding a spur 316 to the pre-cast wall 300, each open end of the channel 66 is selectively closed by a side insert 76 to limit the flow of fluid concrete outwardly from within the channel 66. In this configuration, the void encompassed by the channel and the side inserts defines a second cavity in fluid communication with the first cavity. The side inserts 76 have a planar inner surface 78 keyed to the cross-sectional shape of the channel 66. In one embodiment, each side insert 76 is operatively secured within a corresponding end of the channel 66 such that the side insert inner surfaces 78 are substantially parallel to and aligned with the inner surface 34*a*, 34*b* of the corresponding side rail 16*a*, 16*b*.

Alternatively, when a pre-cast wall 300 without a spur is desired, a selectively removable channel blockout 120 is placed within the channel 66 to effectively prevent fluid concrete from filling the channel 66. The channel blockout 120 defines an upper partition surface 122 which is sized and configured to be removably secured within the channel 66 substantially parallel and adjacent to the platform top surface 22, to serve as a partition between the channel 66 and the remainder of the adjustable mold 10. In the illustrated embodiment, the channel blockout 66 is defined by a solid block which is keyed to the channel 66 and is adapted to be placed in the channel 66 in place of the channel bulkheads 76. In another embodiment, the channel blockout 120 is defined by a plate which is adapted to be secured substantially parallel and adjacent to the platform top surface 22 to cover the channel 66. In still another embodiment, the channel blockout 120 is defined by a rectangular box which is keyed to the channel 66 and is adapted to be placed in the channel 66 between the channel bulkheads 76 to limit the flow of fluid concrete into the channel 66. Those skilled in the art will recognize other configurations suitable for the channel blockout 120 which may be used without departing from the spirit and scope of the present invention.

The interior of the upright form 14 is also visible in FIG. 4. The upright form 14 includes a generally upright upright form wall 58 secured to the frame 20 in an orientation substantially orthogonal to the top surface 22 and spaced apart from the first end 28 of the platform 18. The upright form wall 58 has an upper portion 62 extending above the top surface 22 of the platform 18 (i.e., having a vertical elevation higher than the vertical elevation of the platform top surface 22) and a lower portion 64 extending below the top surface 22 of the platform 18 (i.e., having a vertical elevation lower than the vertical elevation of the platform top surface 22).

Figure 5:
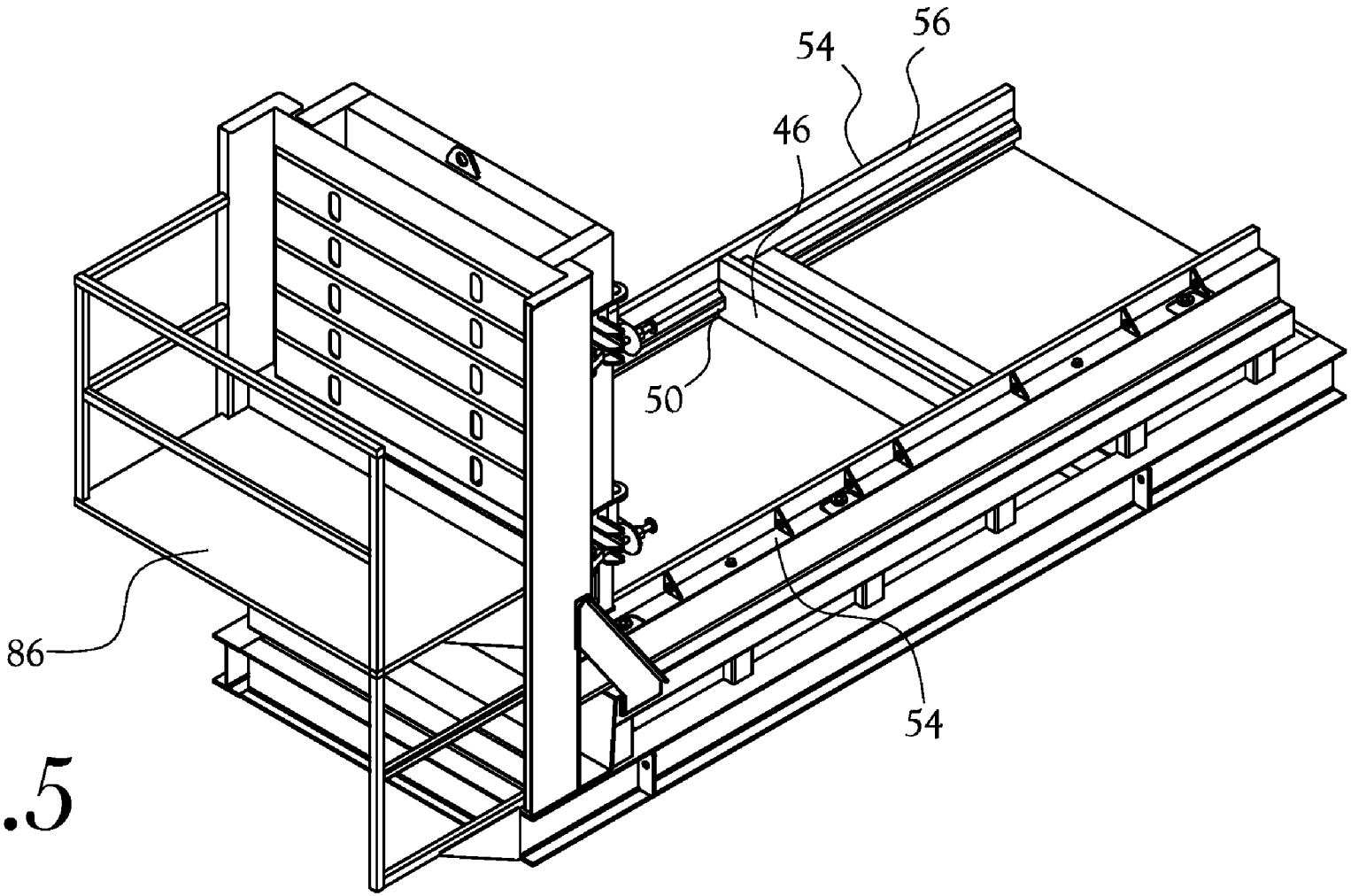
FIG. 5 is another perspective view of the adjustable mold of FIG. 1.

FIG. 5 shows a perspective view of the upright form 14 from the rear. As shown, the upright form wall 58 is formed by a pair of columns 80 that support a plurality of horizontal members 82. The columns 80 are disposed proximate opposite ends of the channel 66 opposite the platform first end 28. The horizontal members 82 cooperate to define a substantially planar surface. The horizontal member inner surfaces 84 are configured to align in a parallel configuration adjacent one another when the horizontal members 82 are arranged in the stacked configuration, such that the horizontal member inner surfaces 84 cooperate to define at least a portion of the substantially planar inner surface 60 of the upright form wall 58. The inner surface 60 of the upright form wall 58 faces the platform 18 and defines a mold negative of a shape desirable for the bottom surface 316 of the footing portion 314 of the pre-cast wall 300. Further, the illustrated embodiment shows a balcony 86 provided adjacent the upright form wall 58 opposite the platform 18 to allow convenient access to the upper portion of the upright form 14, particularly as the height of the upright form increases. However, those skilled in the art will recognize that provision of the balcony 86 is not necessary to accomplish the present invention.

Figure 6:
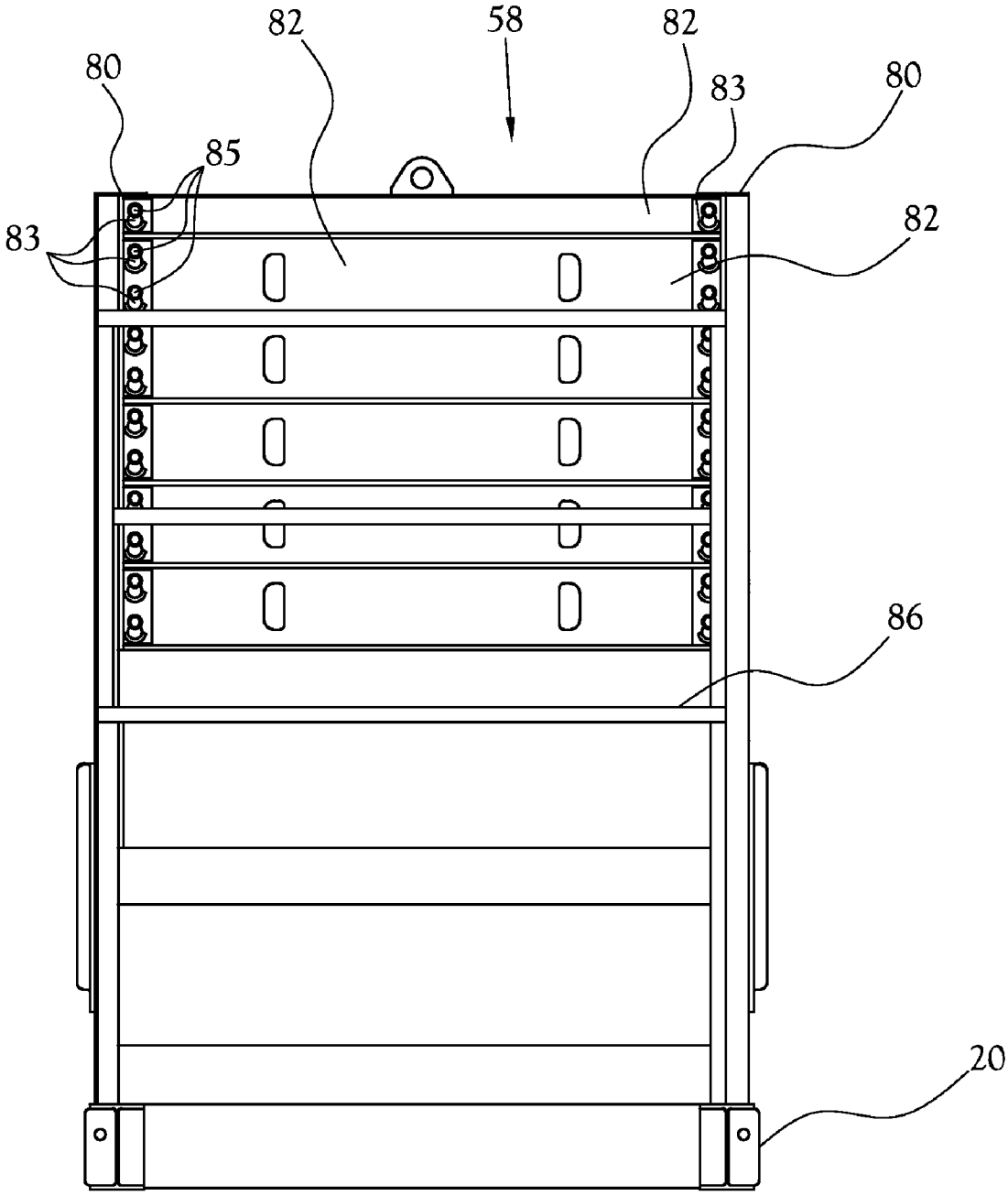
FIG. 6 is a rear-elevation view of the adjustable mold of FIG. 1.

In several embodiments, the overall height of the upright form wall 58 is selectively adjustable. As shown in FIG. 6, the horizontal members 82 are releasably secured to the columns 80. To mount the horizontal members 82, each column 80 includes a plurality of vertically-aligned, spaced-apart bolts 85. Both ends of the horizontal members 82 define a through-opening 83 to receive the bolts 85. By tightening a nut on each bolt, the horizontal members 82 are tightly secured to the columns 80.Those skilled in the art will recognize other connections suitable for releasably connecting the horizontal members 82 to the columns 80 so as to allow for selective adjustment of the height of the upright form wall 58, and such connections may be used without departing from the spirit and scope of the present invention.

Figure 7:
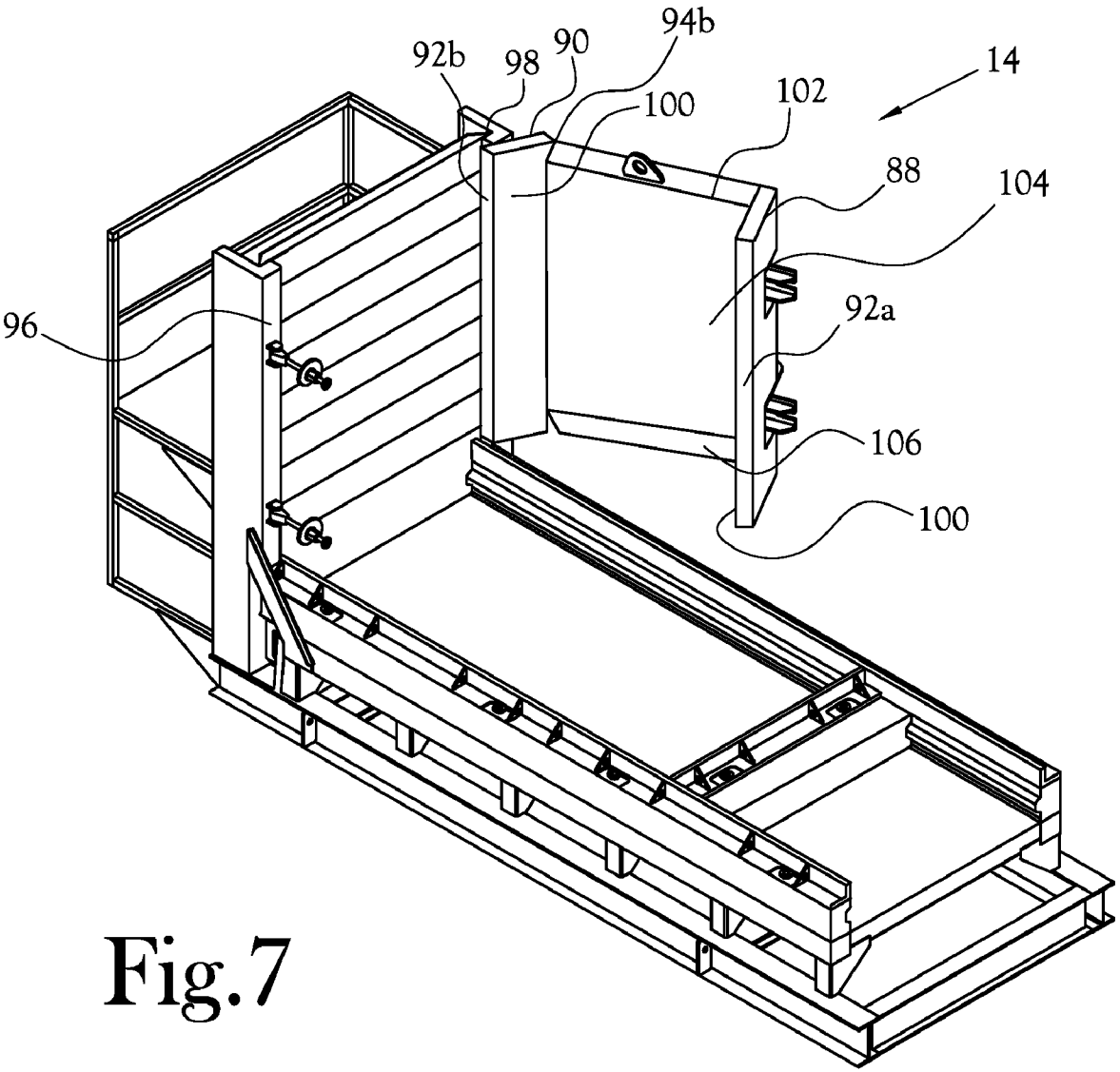
FIG. 7 is a perspective view of the adjustable mold of FIG. 1, showing the bulkheads in an open position.

FIG. 7 illustrates the upright form 14 in an open position. The upright form 14 includes a first bulkhead side member 88 and a second bulkhead side member 90. Each of the first and second bulkhead side members 88, 90 define a first vertical edge 92 and a second vertical edge 94. The first and second bulkhead side members 88, 90 are pivotally and releasably secured to opposite ends of the upright form wall 58. Generally, the first vertical edge 92*a* of the first bulkhead side member 88 is secured to a first vertical edge 96 of the upright form wall 58, and the second vertical edge 92*a* of the second bulkhead side member 90 is secured to a second vertical edge 98 at the opposite end of the upright form wall 58. Each of the first and second bulkhead side members 88, 90 defines an interior surface 100 which is adapted to be secured in a configuration vertically parallel and adjacent to a corresponding channel bulkhead 76 and substantially orthogonally to the wall interior surface 60 and the platform top surface 22. Each of the first and second bulkhead side member interior surfaces 100 defines the mold negative of a shape desirable for the side surfaces 318 of the footing portion 314 of the pre-cast wall 300. In the illustrated embodiment, each of the first and second bulkhead side member interior surfaces 100 is a planar, smooth-textured surface.

A substantially rectangular central bulkhead member 102 is orthogonally connected to the first and second bulkhead side members 88, 90 by hinges 118. Collectively, the central bulkhead member 102 and the first and second bulkhead side members 88, 90 form the bulkhead. The second vertical edges 94*a*, 94*b* of the first and second bulkhead side members are pivotally connected to opposing sides of the central bulkhead member 102. When in the closed position, as shown in FIG. 1, the interior surface 104 of the central bulkhead member 102 faces the interior surface 60 of the upright form wall 58. The central bulkhead member interior surface 104 defines the mold negative of a shape desirable for the top surface 320 of the footing portion 300 of the pre-cast wall. In one embodiment, a portion of the central bulkhead member interior surface 104 along a bottom edge 106 of the central bulkhead member 102 is beveled proximate the wall interior surface 60. In this embodiment, the beveled portion 106 of the central bulkhead member interior surface 104 serves to define the mold negative of a beveled interface 322 between the footing portion 314 and the vertical wall portion 306 of the pre-cast wall 300. However, those skilled in the art will recognize that inclusion of the beveled portion 106 of the central bulkhead member interior surface 104 is not necessary to accomplish the adjustable mold 10 of the present invention.

The upright form wall inner surface 60 cooperates with the central bulkhead member inner surface 104, the first and second bulkhead side member inner surfaces 100, the channel 66, and the channel bulkhead interior surfaces 78 to define a third cavity, which corresponds to the structural footing portion 314 of the pre-cast concrete retaining wall 300. To this extent, as shown in FIG. 1, the lower edge of the central bulkhead member 102 is positioned above and spaced apart from the top surface 22 of the platform. In one embodiment, the lower edge of the central bulkhead member 102 is at a greater height than the side rails 16. In a further embodiment, the lower edge of the central bulkhead member 102 is at a greater height than the rail raisers 54 such that the upper edges of the rail raisers 54 are substantially coplanar to the bottom edge 106 of the central bulkhead member. In this configuration, the central bulkhead member 102, the platform 18, the side rails 16, and the rail risers 54, as applicable, cooperate to form a through passage 108 between the upright form 14 and the platform top surface 22 such that the third cavity, the first cavity, and the second cavity (as applicable) are in fluid communication.

Figure 8:
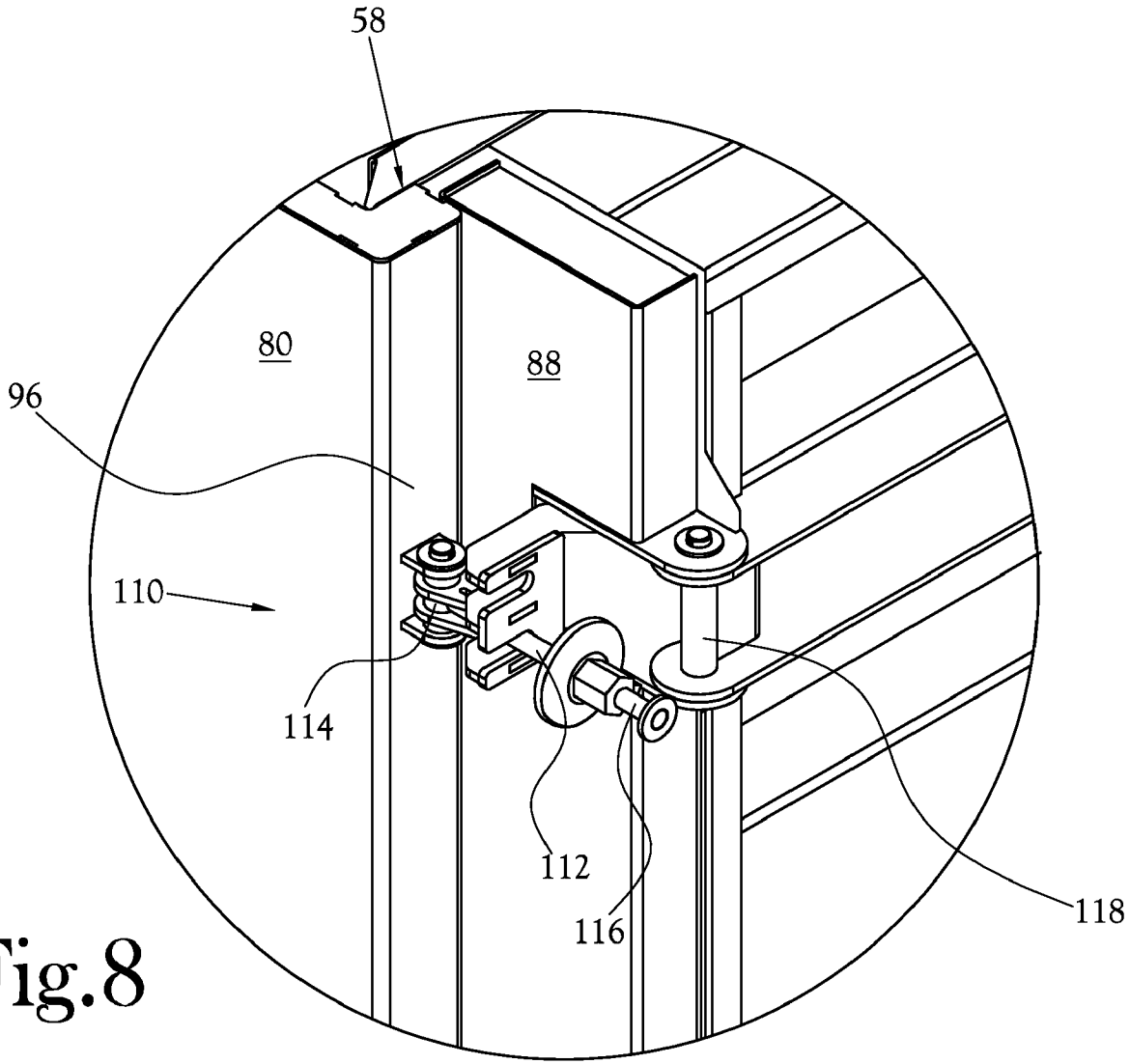
FIG. 8 is a partial perspective view of the adjustable mold of FIG. 1, showing a releasable rotatable connector in greater detail.

FIG. 8 illustrates the connectors used between the upright form wall 58 and the first and second bulkhead side members 88, 90. The upright form includes a plurality of rotatable and releasable connectors 110. Each connector 110 includes a removable post 112 having a first end 114 and a second end 116 that are secured to opposing cooperating surfaces to form a rotatable connection between the connected members. The connectors 110 operatively engaging the corresponding connective edges of the upright form wall 58 and the first and second bulkhead side members 88, 90 permit the bulkhead to secure to and release from one or both sides of the upright form wall 58. In other words, the connectors 110 allow the bulkhead to be selectively opened, closed, and removed. When released from one side, the opposing pivotal connectors 110 permit the bulkhead to swing horizontally thereby providing access to the interior of the upright form. Releasing both sides allows the bulkhead to be removed from the adjustable mold 10 entirely. This allows a worn or damaged bulkhead to be replaced or interchanged with a bulkhead of a different configuration (e.g., having a different size/depth or surface treatment). When secured on both sides, the bulkhead is in an operative position forming the third cavity for molding the footing portion of the pre-cast wall. Those skilled in the art will recognize numerous other configurations for the various operable connections between the corresponding connective edges of the upright form wall 58, the first and second bulkhead side members 88, 90, and the central bulkhead member 102. For example, in another embodiment, the central bulkhead member 102 is removably secured to the first and second bulkhead side members 88, 90. In another embodiment, the central bulkhead member 102 is fixed proximate the first and second bulkhead side members 88, 90 such as by a weld, an integral connection, or other such connection.

Figure 9:
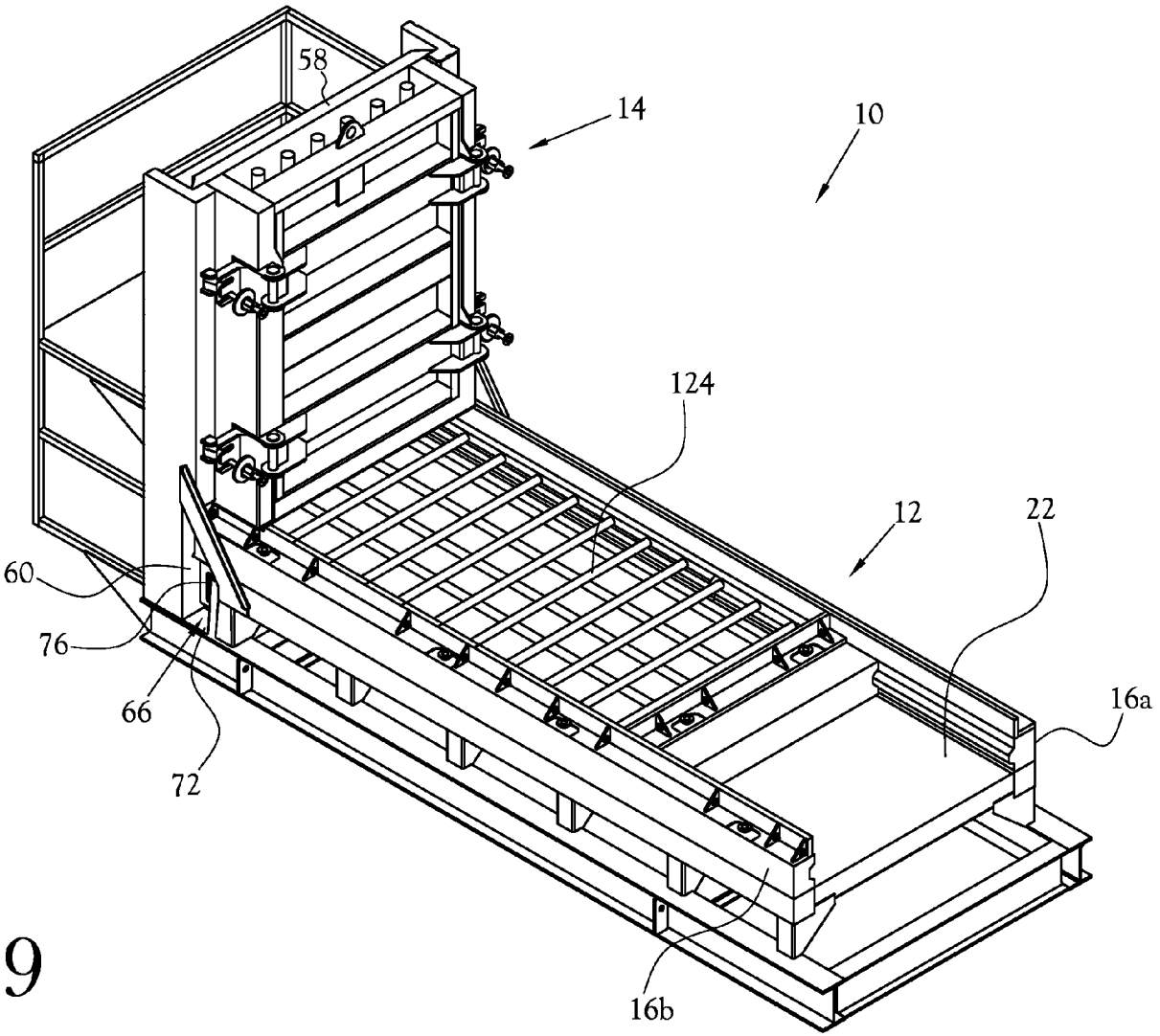
FIG. 9 is a perspective view of the adjustable mold of FIG. 1, showing concrete reinforcement positioned in the cavity.
Figure 10:
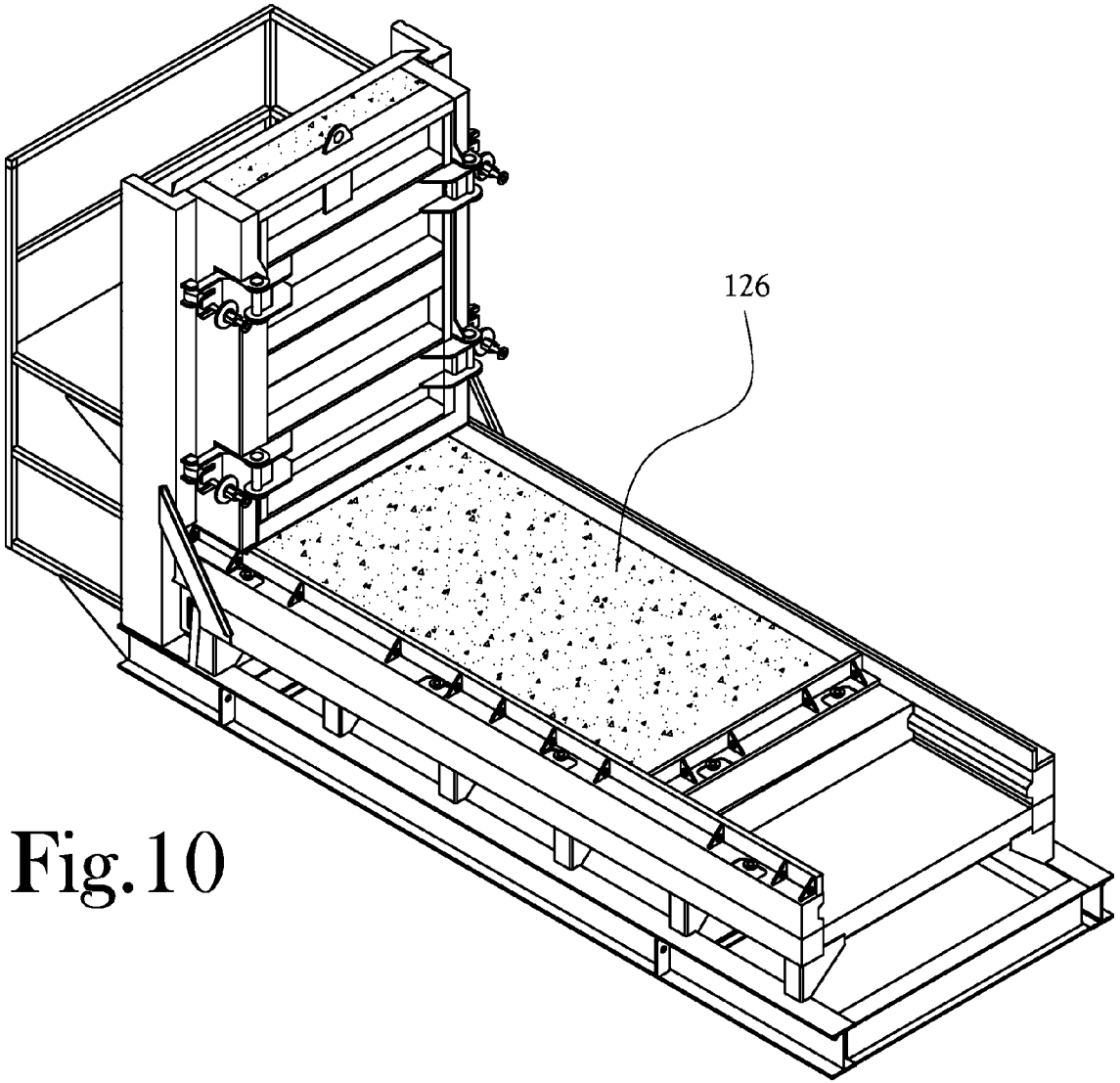
FIG. 10 is a perspective view of the adjustable mold of FIG. 1, showing the cavity filled with concrete.

FIGS. 9 and 10 illustrate a method of use of the adjustable mold 10. As discussed above, the base 12, the upright form 14, and the rails 16*a*, 16*b*, 52 cooperate to define a cavity having the mold negative shape of a pre-cast wall 300. In use, the various rails 16*a*, 16*b*, 52 are positioned and secured proximate the platform top surface 22 to cooperate with the platform top surface 22 to define a mold negative shape of a vertical wall portion 306 of a desired pre-cast wall 300. The channel bulkheads 76 are each secured within a corresponding end of the channel 66 such that the channel bulkhead inner surfaces 78 are each configured substantially orthogonally to the wall inner surface 60, the channel upright surface 68, and the channel bottom surface 72. Suitable concrete reinforcement structures 124 known to one of ordinary skill in the art are assembled and positioned in a desired location within the adjustable mold 10. The central bulkhead member 102 is then closed proximate the upright form wall 58 and the platform 18, such that the wall inner surface 60, the central bulkhead member inner surface 104, the first and second bulkhead side member inner surfaces 100, the channel 66, and the channel bulkhead interior surfaces 78 cooperate to define the portion of the adjustable mold corresponding to the structural footing portion 314 of the desired pre-cast concrete retaining wall 300. Subsequently, as shown in FIG. 10, the cavity is substantially filled with fluid concrete 126 to substantially surround the concrete reinforcement structures 124 using procedures known to one of ordinary skill in the art. Once placed within the cavity of the adjustable mold 10, the fluid concrete is allowed to cure to form the desired pre-cast wall 300. One the concrete has cured, the central bulkhead member 102 is opened, and the cured pre-cast wall 300 is removed from the adjustable mold 10.

Figure 11:
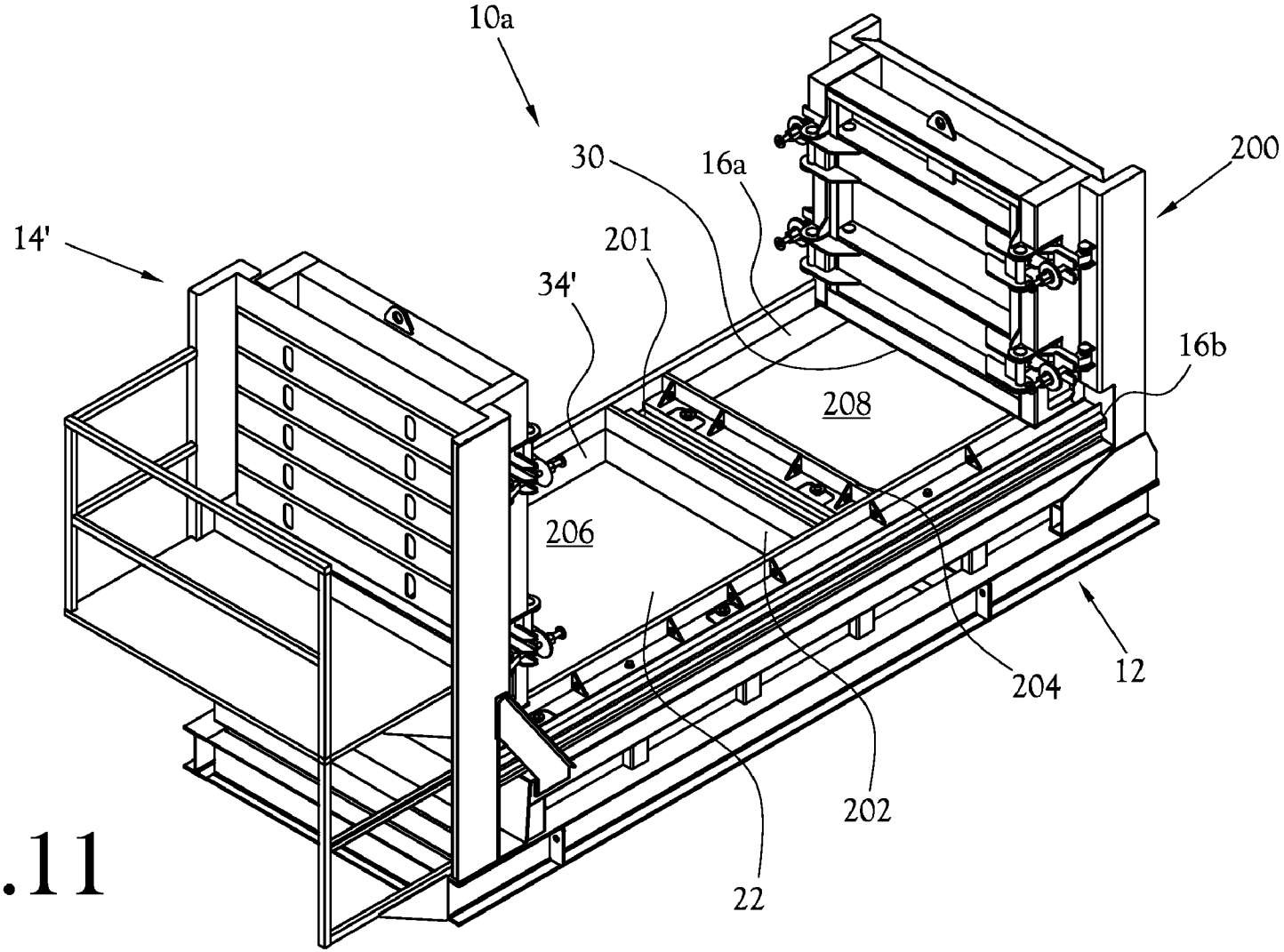
FIG. 11 is a perspective view showing another embodiment of the adjustable mold of the present invention.

FIG. 11 illustrates an alternative embodiment of the adjustable mold 10*a* of the present invention for molding two pre-cast walls at the same time. A second upright form 200 is provided at the platform second end 30. As shown in FIG. 11, the adjustable mold 10*a* includes a single header rail 201 having a first vertical surface 202 for the first pre-cast wall and an opposite second vertical surface 204 for the second pre-cast wall. Both the first and second header rail vertical surfaces 202, 204 are adapted to be positioned substantially orthogonally to the platform top surface 22 and substantially orthogonally to each of the side rail interior surfaces 34, such that the header rail 201 partitions the base 12 into a first portion 206 and a second portion 208. Each of the first and second header rail vertical surfaces 202, 204 defines the mold negative of a shape desirable for the top surface 312 of the vertical wall portion 306 of a pre-cast wall. The base first portion 206, the first upright form 14, the side rails 16, and the header rail 201 cooperate to define a first cavity adapted to form a first pre-cast wall, while the base second portion 208, the second upright form 200, the side rails 16, and the header rail 201 cooperate to define a second cavity adapted to form a second pre-cast wall. Accordingly, the adjustable mold 10*a* is capable of simultaneously producing two pre-cast walls. Alternatively, a second header rail forms the top of the second pre-cast wall allowing for independent adjustment of the sizes of the first and second portions 206, 206 defining the height of the two pre-cast walls.

Figure 12A:
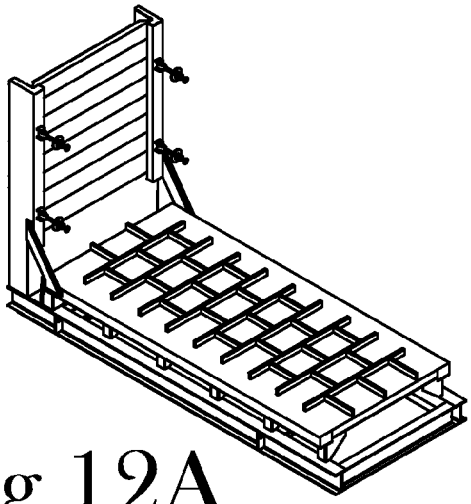
FIG. 12A is a perspective view of the base and wall portions of the adjustable mold shown in FIG. 2, showing an interchangeable plate defining a brick texture.
Figure 12B:
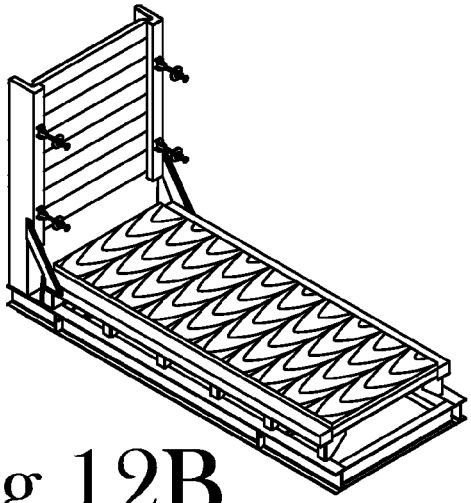
FIG. 12B is a perspective view of the base and wall portions of the adjustable mold shown in FIG. 2, showing an interchangeable plate defining a wood texture.
Figure 12C:
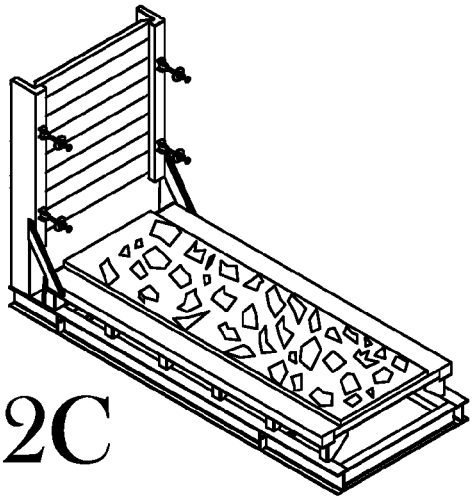
FIG. 12C is a perspective view of the base and wall portions of the adjustable mold shown in FIG. 2, showing an interchangeable plate defining a rock texture.

FIGS. 12A to 12C illustrate various embodiments of the adjustable mold for producing a pre-cast wall having differing textures on the exterior surface. The top surface 22 is contoured to define the mold negative of a textured shape desirable for the external surface of the pre-cast wall 300. In the embodiment of FIG. 12A, the top surface 22 of the platform 18 is contoured to define the mold negative of a surface of a wall constructed of masonry units such as stone, brick, concrete masonry units, or the like. In the embodiment of FIG. 12B, the top surface 22 of the platform 18 is contoured to define the mold negative of a surface of a wall constructed from wood. In the embodiment of FIG. 12C, the top surface 22 of the platform 18 is contoured to define the mold negative of a natural rock surface. Those skilled in the art will recognize that the top surface 22 can be contoured to define numerous other shapes or textures desirable for the external surface of the pre-cast wall 300 without departing from the spirit and scope of the present invention, such as an artistic design or an emulation of another material (wood, stone, brick, etc.).

From the foregoing description, it will be recognized by those skilled in the art that an adjustable mold for manufacturing a pre-cast retaining wall has been provided. The adjustable mold for manufacturing a pre-cast retaining wall provides a cavity adapted to hold a combination of fluid concrete and concrete reinforcement in the shape of a pre-cast cantilevered concrete retaining wall and to allow curing of the fluid concrete sufficient to form the pre-cast cantilevered concrete retaining wall. While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An adjustable mold for manufacturing a pre-cast retaining wall, said adjustable mold comprising:

a platform having a substantially horizontal orientation, said platform defining a top surface, a first side, a second side substantially parallel to said first side, a first end, and a second end, said top surface defining a mold negative shape of a texture for an external surface of the pre-cast retaining wall;

a first side rail and a second side rail operatively connected to said platform proximate to and substantially parallel to opposing sides, said first side rail and said second side rail extending upwardly from said top surface;

a header rail operatively connected to and spanning between said first rail and said second rail at a selected distance from said platform second end;

said first rail, said second rail, and said header rail cooperating to define a first cavity;

a upright form wall spaced apart from said platform first end and oriented substantially orthogonal to said platform top surface, said upright form wall defining an upper portion extending above said platform top surface and a lower portion extending below said platform top surface;

a channel member defining a channel between said upright form wall and said platform first end, said channel opening upward and extending downward from said platform top surface;

a first channel side member and a second channel side member operatively connectable to opposing sides of said channel member, respectively;

said channel member, said first channel side member, and said second channel side member cooperating to define a second cavity in fluid communication with said first cavity;

a central bulkhead member spaced apart from said upright form wall, located proximate to and upward from said platform first end, and oriented substantially orthogonal to said platform top surface;

a first bulkhead side member and a second bulkhead side member operatively and selectively connected to opposing sides of said central bulkhead member and opposing sides of said upright form wall upper portion, said central bulkhead member, said first bulkhead side member, and said second bulkhead side member cooperating to define a bulkhead, wherein at least one of said first bulkhead side member and said second bulkhead side member pivotally connected to said upright form wall along a vertical axis; and said bulkhead and said upright form wall upper portion cooperating to define a third cavity in fluid communication with said first cavity and said second cavity.

2. The adjustable mold of claim 1 further comprising a channel blockout adapted to be secured within said channel, said channel blockout having a surface configured to extend from said platform first end to said upright form wall to limit fluid communication with said channel.

3. The adjustable mold of claim 1 wherein said first side rail has an interior surface defining a mold negative shape of a groove and said second side rail has an interior surface defining a mold negative shape of a tongue keyed to said groove.

4. The adjustable mold of claim 1 wherein said first side rail and said second side rail are releasably secured to said platform.

5. The adjustable mold of claim 1 wherein said platform is fabricated from a magnetic material, said first side rail and said second side rail being magnetically secured to said platform.

6. The adjustable mold of claim 1 wherein said platform is fabricated from a magnetic material, said header rail being magnetically secured to said platform.

7. The adjustable mold of claim 1 wherein said platform is fabricated from a magnetic material, said adjustable mold further comprising a plurality of magnetic fasteners associated with said header rail, said first side rail, and said second side rail, said plurality of magnetic fasteners selectively securing and releasing each of said header rail, said first side rail, and said second side rail to and from said platform.

8. The adjustable mold of claim 1 further comprising a plurality of risers operatively connectable to said header rail, said first side rail, and said second side rail, each said plurality of risers having a substantially vertical interior surface that is vertically aligned with and parallel to the interior surface of at least one of said header rail, said first side rail, and said second side rail.

9. The adjustable mold of claim 1 wherein said platform top surface defines the mold negative shape of the surface of said pre-cast retaining wall constructed from one of the group consisting of wood, stone, brick, and concrete masonry units.

10. The adjustable mold of claim 1 wherein said platform top surface is a selectively replaceable plate defines the mold negative shape of the texture surface for said pre-cast retaining wall.

11. The adjustable mold of claim 1 further comprising a plurality of releasable and rotatable fasteners, each of said plurality of releasable and rotatable fasteners being configured to selectively secure one of said first and second bulkhead side members to said upright form wall.

12. The adjustable mold of claim 11 wherein each of said plurality of releasable and rotatable fasteners comprising a post having a first end and a second end, each said first end being hinged proximate said upright form wall, each said second end being are releasably fixed proximate one of said first and second bulkhead side members.

13. The adjustable mold of claim 1 wherein each of said first and second bulkhead side members are hinged to said central bulkhead member.

14. The adjustable mold of claim 1 wherein said upright form wall further comprises:

a first upright member secured proximate a first end of said channel;

a second upright member secured proximate to an opposing second end of said channel; and a plurality of horizontal members adapted to be secured between said first and second upright members, each of said horizontal members defining a substantially planar vertical surface configured to align in a parallel configuration adjacent another horizontal member vertical surface to define an upright form wall inner surface of variable height.

15. The adjustable mold of claim 1 wherein said first channel side member and said second channel side member are a pair of channel inserts, each channel insert having a planar inner surface keyed to a cross-section of said channel and selectively secured at opposing ends of said channel to limit a flow of fluid concrete outwardly from within said channel.

* * * * *